US006243051B1

(12) United States Patent
Vanstrum et al.

(10) Patent No.: US 6,243,051 B1
(45) Date of Patent: Jun. 5, 2001

(54) DUAL HELICAL ANTENNA FOR VARIABLE BEAM WIDTH COVERAGE

(75) Inventors: Mark D. Vanstrum, Indialantic; Robert A. Corbit, Melbourne; Timothy L. Yost, Malabar, all of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/435,287

(22) Filed: Nov. 5, 1999

(51) Int. Cl.[7] ..... H01Q 1/36
(52) U.S. Cl. ..... 343/895; 434/840
(58) Field of Search ..... 343/895, 729, 343/833, 834, 840, 878, 879; H01Q 1/36

(56) References Cited

U.S. PATENT DOCUMENTS

| | | | |
|---|---|---|---|
| 4,742,359 | 5/1988 | Ishino et al. | 343/895 |
| 5,081,469 | 1/1992 | Bones | 343/895 |
| 5,138,331 | 8/1992 | Josypenko | 343/895 |
| 5,329,287 | 7/1994 | Strickland | 343/752 |
| 5,345,248 | 9/1994 | Hwang et al. | 343/895 |
| 5,347,286 | 9/1994 | Babitch | 342/424 |
| 5,444,455 | 8/1995 | Louzir et al. | 343/895 |
| 5,625,368 | 4/1997 | Howson et al. | 343/753 |
| 5,793,338 | 8/1998 | Standke et al. | 343/895 |
| 5,892,480 | 4/1999 | Killen | 343/385 |
| 5,926,146 | 7/1999 | Seck | 343/725 |

*Primary Examiner*—Tan Ho
*Assistant Examiner*—Shih-Chao Chen
(74) *Attorney, Agent, or Firm*—Allen, Dyer, Doppelt, Milbrath & Gilchrist, P.A.

(57) ABSTRACT

An antenna is disclosed for use in emitting the signals in times of conflict to overcome jamming. The antenna comprises a reflector having a focal point and a central support shaft extending axially from the reflector on bore through the focal point. First and second selectable, multi-turn axial mode helical antenna elements are disposed on-bore on the central support shaft, spaced linear from each other, and wound to have the same polarity. One of the helical antenna elements is disposed at the focal point, and the other helical antenna element is disposed at a defocused position to broaden a transmit energy beam and area of regard.

42 Claims, 6 Drawing Sheets

Unspoiled 845 Km and 1020 Km
diameter AOR's at L1/L2 respectively

Spoiled 2356 Km and 2708 Km
diameter AOR's at L1/L2 respectively

DUAL HELICAL ANTENNA FOR VARIABLE BEAM WIDTH COVERAGE

FIELD OF THE INVENTION

This invention relates to antenna systems, and more particularly, this invention relates to an antenna having helical antenna elements.

BACKGROUND OF THE INVENTION

A conventional satellite antenna system used for generating global positioning system (GPS) and similar signals typically includes the satellite body having a controller and transmitter. An earth deck panel is connected to the satellite body and includes phased array antenna elements supported by the earth deck panel that emits the GPS signals. However, in hostile areas in time of war, or when special operations are performed, such as by special forces, the hostile areas have enemy jamming stations that make the receipt of GPS signals difficult. Thus, not only do special forces in hostile areas have difficulty receiving GPS signals, but also cruise missiles and other modern electronic devices have trouble receiving the GPS signals because of jamming interference. This area of conflict could be a larger or smaller area depending on the fact situation. Depending on the particular problem, greater signal power must be generated over the area of regard.

SUMMARY OF THE INVENTION

It is therefore an object of the present invention to provide an antenna that is selectable to broaden a transmitted energy beam and area of regard, such as for global positioning system signals in hostile areas.

In accordance with the present invention, the antenna includes a reflector having a focal point. A central support shaft extends axially from the reflector to the focal point. First and second selectable, multi-turn axial mode helical antenna elements are disposed on-bore on the central support shaft and spaced linearly from each other. The helical antenna elements are wound to have the same polarity. One of the helical antenna elements is disposed at the focal point, and the other helical antenna element is disposed at a defocused position to broaden the transmitted energy beam and area of regard.

In still another aspect of the present invention, first and second independent feed lines extend to respective first and second helical antenna elements. An antenna feed line switch is operatively connected to the first and second independent feed lines for switching from one feed line into the other feed line to switch between a narrow beam and a broadened energy beam and area of regard.

The first helical antenna element can be spaced distal from the reflector at the focal point, and the second helical antenna element can be spaced proximal to the reflector. The first and second independent feed lines connect to the respective first and second antenna elements. First and second ground planes are mounted on the central support shaft in spaced relation from each other and are operative with respective first and second helical antenna elements. The ground planes can be formed as circular plates supported on the central support shaft.

In still another aspect of the present invention, the first and second helical antenna elements comprise monofilar wire wound around the central support shaft. The helical antenna elements could be wound to have right-hand or left-hand polarization. The central support shaft further comprises material formed as a dielectric.

In still another aspect of the present invention, a satellite system of the present invention comprises a satellite body having a transmitter for generating signals to the earth. An earth deck panel is part of the satellite body. Phased array antenna elements are supported by the earth deck panel and emit the signals. A reflector boom extends from the satellite body. The antenna of the present invention is supported by the reflector boom for use in emitting the signals in times of conflict to overcome jamming.

The antenna includes the reflector having a focal point and a central shaft extending axially from the reflector through the focal point. First and second selectable, multi-turn axial mode helical antenna elements are disposed on the central support shaft, spaced linear from each other, and wound to have the same polarity. One of the helical antenna elements is disposed at the focal point, and the other helical antenna element is disposed at a defocused positioned to broaden a transmitted energy beam and area of regard.

A transmission line is operatively connected to the antenna feed line switch for carrying signals to be transmitted from the antenna. The central support shaft can include a passageway extending axially therethrough that receives the first and second independent feed lines.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because the antenna spot beam coverage for selected Areas of Regard (AOR) can be varied from the satellite without using complex phased array feeds or a mechanically movable combination of feeds on the portable booms. Thus, physically large, mechanically and electrically complex and difficult packaging of reflectors is not required.

The present invention is also advantageous because it uses a simple, dual helix satellite antenna configuration co-located on-bore using a central support shaft extending axially from the reflector through a focal point. First and second selectable, multi-turn axial mode helical antenna elements are disposed on the central support shaft and spaced linear from each other. The antenna elements are wound to have the same polarity. One of the helical antenna elements is disposed at the focal point, and the other helical antenna element is disposed at a defocused position to broaden a transmitted energy beam and area of regard. The helical antenna elements can be fed by independent feed lines and both helical antenna elements possibly could be excited at the same time, with one antenna element having a broad beam to acquire a target and another antenna element having a narrow beam for tracking. This application, however, is different from the GPS configuration.

Although the invention will be described with reference to the global positioning system (GPS), the antenna and satellite antenna system as described can be used for a number of different applications as known and suggested to those skilled in the art.

Figure 1:
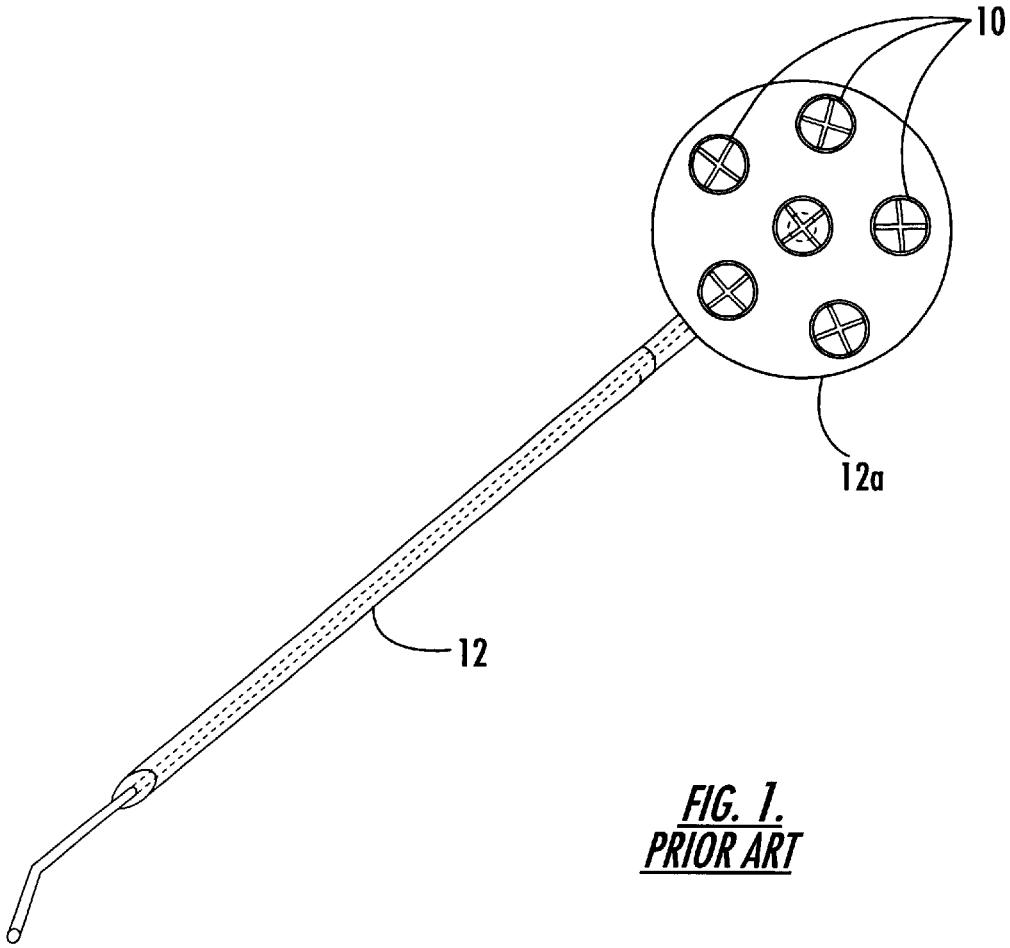
FIG. 1. PRIOR ART
FIG. 1 is a plan view of a prior art phased array feed.
Figure 2:
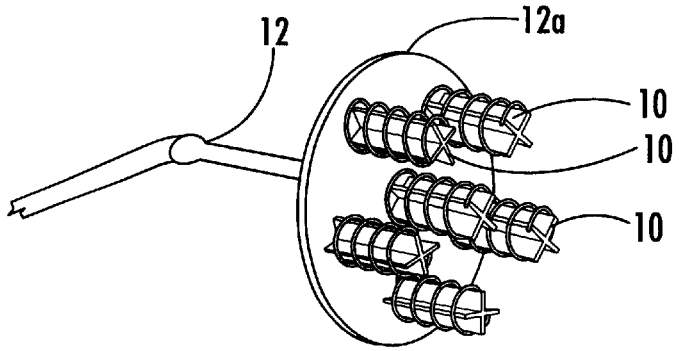
FIG. 2. PRIOR ART
FIG. 2 is an isometric view of the phased array feed of FIG. 1.
Figure 3:
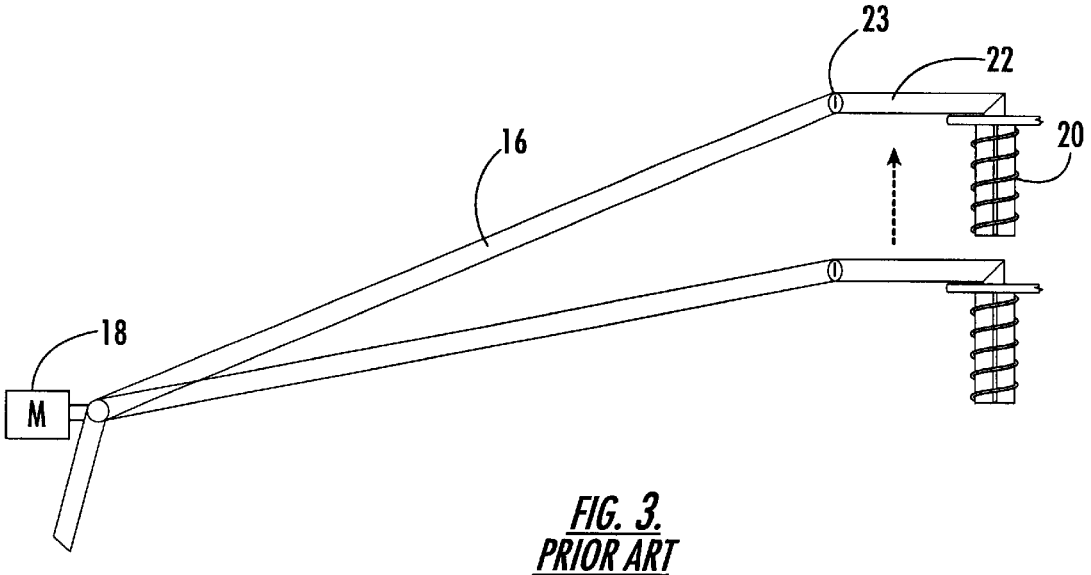
FIG. 3. PRIOR ART
FIG. 3 is a schematic drawing of a mechanically movable combination of feeds used in the prior art.

FIGS. 1 and 2 illustrate prior art phased array solutions that are typically used in a conventional satellite having a satellite body and transmitter for generating signals, such as GPS signals. The phased array elements 10 can be positioned on the earth deck panel or formed as part of a separate boom 12 and base plate 12*a* as shown in FIGS. 1 and 2. In another prior art device, a separate boom 16 could be movable as shown in FIG. 3 prior art where a motor 18 can mechanically move an antenna element 20 positioned on an upper boom 22, which could be received on joint 23 to ensure alignment.

The present invention is particularly relevant to the global positioning system using the satellite-based radio system to provide worldwide coverage, high accuracy three-dimensional position, velocity and time. As is known to those skilled in the art, the system operates typically on two frequencies, i.e., 1575.42 MHZ (L1) and 1227.5 MHZ (L2), to permit compensation for ionospheric propagation delays. Satellites typically transmit two codes, the 1.023 Mbps, C/A code and the 10.23 Mbps P code that is encrypted into a Y code for military users. Users typically receive and determine at least four pseudoranges by time-of-arrival measurements with respect to a ground user receiver's clock time. The user can also determine four pseudorange rates or delta pseudoranges via Doppler measurements. In times of crisis, normal global positioning systems used in satellites may not work adequately because of jamming interference by enemy soldiers or installations. The present invention overcomes those disadvantages by having an additional antenna with a dual helix antenna configuration co-located on a bore site axis. The antenna elements can be selectively chosen to allow a more finite Area of Regard from a satellite or an unfocused, broader area with greater Area of Regard for greater coverage.

Figure 4:
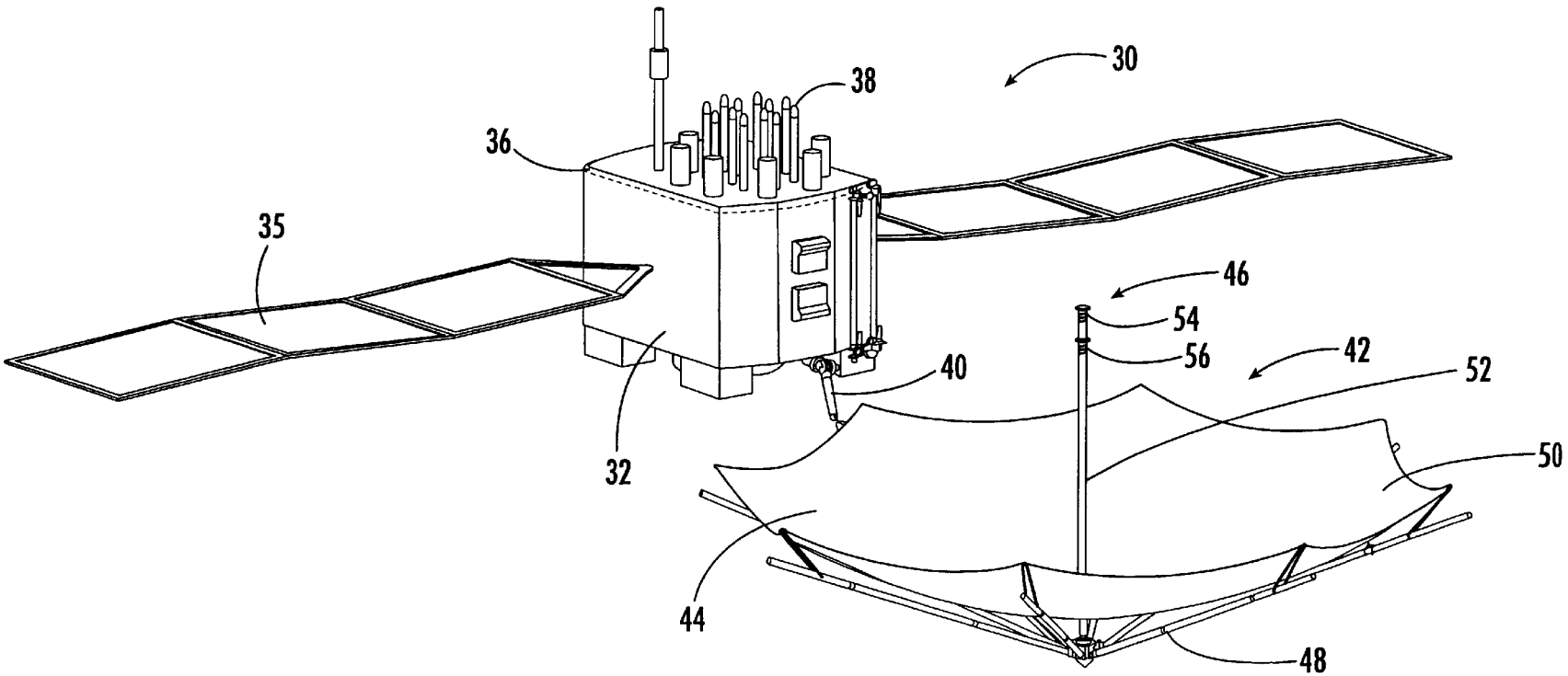
FIG. 4 is an isometric view of the satellite antenna system of the present invention.

FIG. 4 illustrates one example of a satellite antenna system 30 for transmitting GPS signals that includes a satellite body 32 as known to those skilled in the art having a transmitter 34 (FIG. 5) for generating signals, such as global positioning system signals and other signals to earth. A processor 34*a* and controller 34*b* also work together in conjunction with the transmitter 34 to control and generate appropriate GPS and other signals. The satellite includes a solar array 35 as is known to those skilled in the art. An earth deck panel 36 is formed as part of the satellite body 32 and includes phased array antenna elements 38 supported by the earth deck panel 36 for emitting the signals. A reflector boom 40 extends from the satellite body 32, and a second antenna 42 of the present invention is supported by the reflector boom 40 for use in emitting signals in times of conflict to overcome jamming. The antenna 42 includes a reflector 44 having a focal point 46 as is known to those skilled in the art. The reflector 44 includes the extendible support arms 48 and reflector mesh 50 that allows the antenna to be collapsed on initial rocket take-off and delivery and then extended once the satellite is in orbit. The central support shaft 52 extends axially from the reflector on-bore through the focal point 46 as shown in FIG. 4.

First and second multi-turn axial mode helical antenna elements 54, 56 are disposed on the central support shaft 52 and spaced linear from each other. The helical antenna elements 54, 56 are wound to have the same polarity. The helical antenna elements 54, 56 are a helically wound antennae that consist of a spiral conductor. The length-to-diameter ratio of the helical antenna elements are small, and the helical antenna element operates in the axial mode and radiates off the end opposite the feed point. The polarization is circular for the axial mode, with left or right circularity, depending on whether the helix is wound clockwise or counter-clockwise. The ground plane can be a screen or other conductor, for example, 0.8 $\lambda$ to 1.1 $\lambda$ diameter or on a side for a square ground plane. The circumference of the coil can be between about 0.75 $\lambda$ and 1.33 $\lambda$ for the antenna to radiate in an axial mode, although it need not be limited to these values. Usually the coil has at least three turns to radiate in the axial mode. As a non-limiting example only, the ratio of the spacing between turns (in wavelengths), $S_\lambda$ to $C_\lambda$ should be in the range of about 0.2126 to about 0.2867. Usually the ratio range results in the requirement that the pitch angle, $\alpha$ of a helix be between about 12° and 16° where $\alpha$ equals the arc tan of $S_\lambda/C_\lambda$. Thus, with these constraints, a single main load is typically generated along the axis of the coil.

Figure 5:
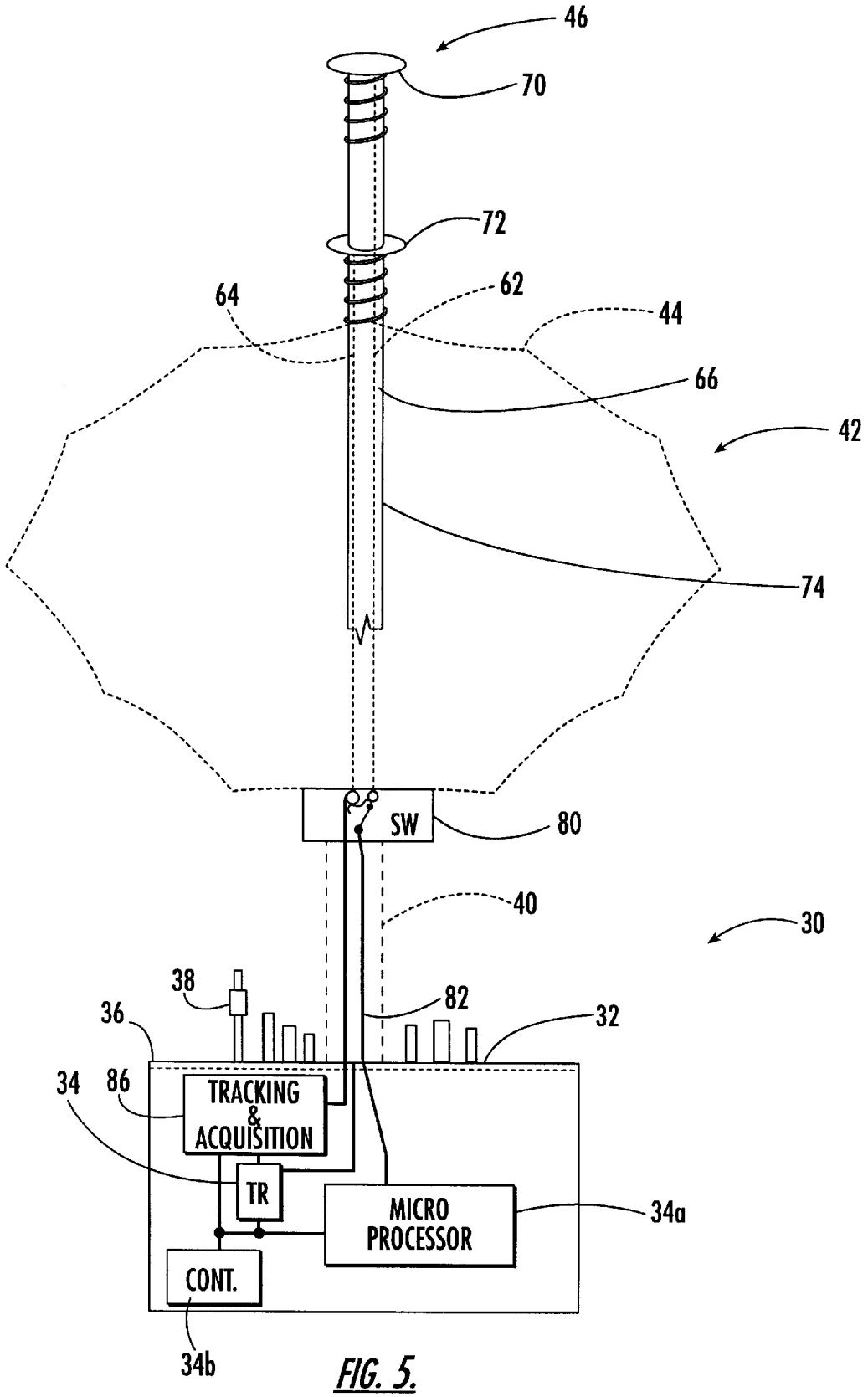
FIG. 5 is a schematic illustration of the satellite antenna system showing the selectable use of helical antenna elements.
Figure 6:
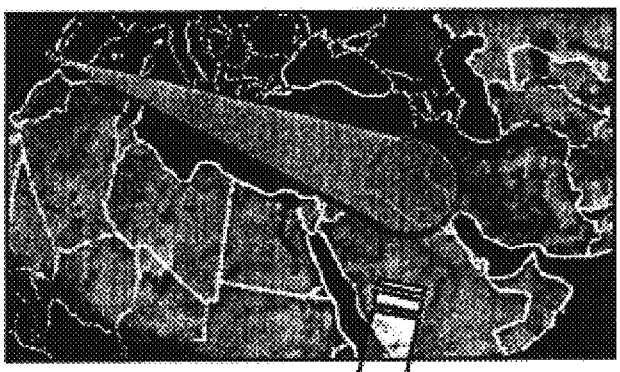
FIGS. 6–9 illustrate images of unspoiled and spoiled areas of regard based on standard L1/L2 frequency ranges.
Figure 7:
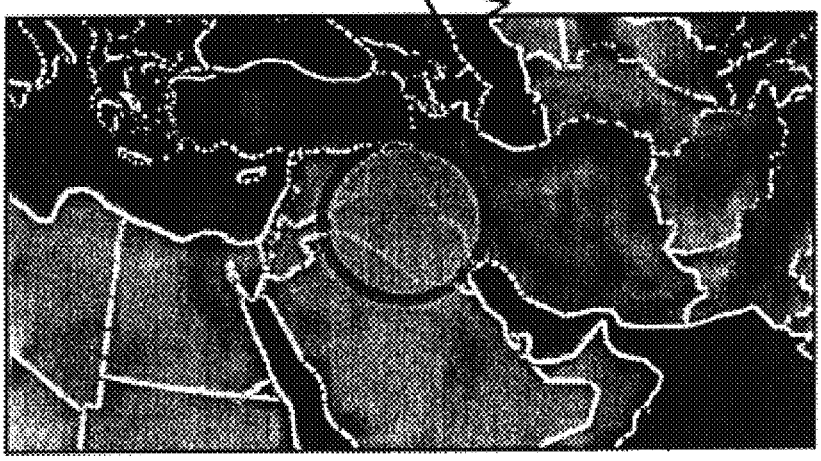

As shown in greater detail in FIG. 5, the first helical antenna element 54 is spaced distal from the reflector 44 at the focal point, and the second helical antenna element 56 is spaced proximal to the reflector 44. The first and second helical antenna elements are typically formed as monofilar wire wound around the central support shaft 52. The wire can typically be copper and the antenna elements are wound to have right-hand polarization, although left-hand polarization can also be used. The central support shaft 52 is formed from a material that is a dielectric, such as a kevlar.

First and second independent feed lines 62, 64 extend to the respective first and second helical antenna elements 54, 56. The feed lines 62, 64 can extend through the central support shaft 52 via a passageway 66 that extends axially therethrough. The two helical antenna elements can be selectable to operate either alone or together for acquisition and tracking. For example, the first helical antenna element 54 positioned at the focal point provides a strong, focused signal, while the second helical antenna element 56 that is unfocused broadens the Area of Regard and the transmitted energy beam to cover a wider area. As illustrated, first and second ground planes 70, 72 are mounted on the central support shaft 74 in spaced relation from each other and operative with respective first and second helical antenna elements. The ground planes 70, 72 are formed as circular plates supported on the central support shaft 52.

In one aspect of the present invention, an antenna feed line switch 80 is operatively carried by the antenna and operatively connected to the first and second independent feed lines 62, 64 for switching from one feed line into the other feed line to switch between a narrow beam and a broadened energy beam and the area of regard. The switch 80 would not necessarily be present if the two feeds were used "together" simultaneously. A transmission line 82 is operatively connected to the antenna feed line switch 80 for carrying signals to be transmitted from the antenna and originally generated by the transmitter 34. As noted before, it is also possible to operate both helical antenna elements at the same time through a tracking and acquisition controller 86 that connects directly to the separate antenna feed lines as shown in FIG. 5.

Figure 8:
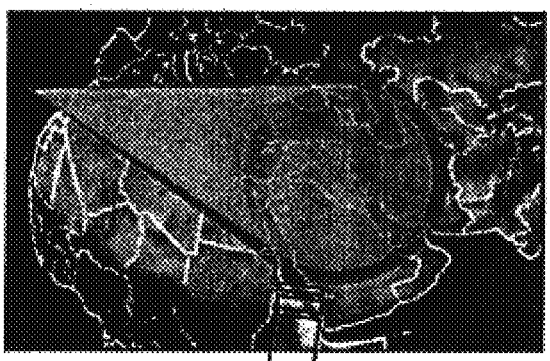
Figure 9:
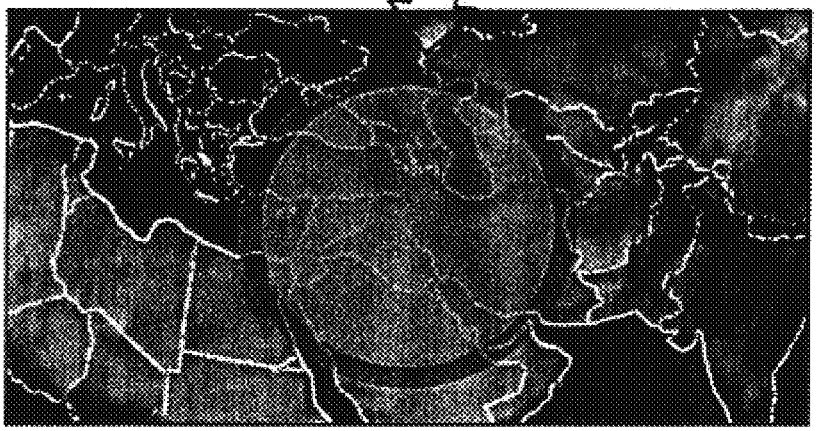

FIGS. 6–9 show various images where the unspoiled (distal) helical antenna element 54 is used at 845 kilometers and 1,020 kilometers diameter area of regard at respective L1 and L2 frequencies. FIGS. 8 and 9 show the spoiled use of the unfocused helical antenna element 56 showing the 2,356 kilometer and 2,708 kilometer diameter area of regard at L1 and L2 respectively.

It is evident that the present invention is advantageous because not only is a readily compact design used that does not require a mechanically or electrically complex feed, but the design also frustrates jamming. The dual helix satellite antenna configuration is co-located on a bore site axis to provide the useful configuration as described above. The helical antenna element can be selected separately to change the area of regard. Additionally, both helical antenna elements can be excited to allow a broad beam to acquire the target and a narrow beam for tracking. Because of the mesh design of the reflector and the support arm structure, the antenna element can be folded in a compact configuration during initial launch of the satellite.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. An antenna comprising:

a reflector having a focal point;

a central support shaft extending axially from the reflector through the focal point;

first and second selectable, multi-turn axial mode helical antenna elements disposed on-bore on the central support shaft, spaced linear from each other, and wound to have the same polarity, wherein one of said helical antenna elements is disposed at the focal point and the other helical antenna element is disposed at a defocused position to broaden a transmitted energy beam and area of regard.

2. An antenna according to claim 1, wherein said first helical antenna element is spaced distal from said reflector at the focal point, and said second helical antenna element is spaced proximal to the reflector.

3. An antenna according to claim 1, and further comprising first and second independent feed lines connecting respective first and second antenna elements.

4. An antenna according to claim 1, and further comprising first and second ground planes mounted on said central support shaft in spaced relation from each other and operative with respective first and second helical antenna elements.

5. An antenna according to claim 4, wherein said ground planes are formed as circular plates supported on said central support shaft.

6. An antenna according to claim 1, wherein said first and second helical antenna elements comprises monofilar wire wound around said central support shaft.

7. An antenna according to claim 1, wherein said helical antenna elements are wound to have one of either right-hand or left-hand polarization.

8. An antenna according to claim 1, wherein said central support shaft comprises a material formed as a dielectric.

9. An antenna comprising:

a reflector having a focal point;

a central support shaft extending axially from the reflector through the focal point;

first and second multi-turn axial mode helical antenna elements disposed on-bore on the central support shaft, spaced linear from each other, and wound to have the same polarity, wherein one of said helical antenna elements is disposed at the focal point and the other helical antenna element is disposed at a defocused position to broaden a transmitted energy beam and area of regard;

first and second independent feed lines extending to respective first and second helical antenna elements; and an antenna feed line switch operatively connected to said first and second independent feed lines for switching from one feed line into the other feed line to switch between a narrow beam and a broadened energy beam and area of regard.

10. An antenna according to claim 9, and further comprising a transmission line operatively connected to said antenna feed line switch for carrying signals to be transmitted from said antenna.

11. An antenna according to claim 9, wherein said first helical antenna element is spaced distal from said reflector at the focal point, and said second helical antenna element is spaced proximal to the reflector.

12. An antenna according to claim 9, wherein said central support shaft includes a passageway extending axially therethrough that receives said first and second independent feed lines.

13. An antenna according to claim 9, and further comprising first and second ground planes mounted on said central support shaft in spaced relation from each other and operative with respective first and second helical antenna elements.

14. An antenna according to claim 13, wherein said ground planes are formed as circular plates supported on said central support shaft.

15. An antenna according to claim 9, wherein said first and second helical antenna elements comprises monofilar wire wound around said central support shaft.

16. An antenna according to claim 9, wherein said central support shaft comprises a material formed as a dielectric.

17. An antenna according to claim 9, wherein said helical antenna elements are wound to have one of either right-hand or left-hand polarization.

18. A satellite antenna system comprising:

a satellite body having a transmitter for generating ground-to-earth signals, an earth deck panel, and phased array antenna elements supported by said earth deck panel for emitting the signals;

a reflector boom extending from said satellite body;

an antenna supported by said reflector boom for use in emitting the signals, said antenna comprising:

a reflector having a focal point; and first and second selectable, multi-turn axial mode helical antenna elements disposed on-bore and spaced linear from each other, and wound to have the same polarity, wherein one of said helical antenna elements is disposed at the focal point and the other helical antenna element is disposed at a defocused position to broaden a transmitted energy beam and area of regard.

19. A satellite antenna system according to claim 18, wherein said first helical antenna element is spaced distal from said reflector at the focal point, and said second helical antenna element is spaced proximal to the reflector.

20. A satellite antenna system according to claim 18, and further comprising first and second independent feed lines connecting respective first and second antenna elements.

21. A satellite antenna system according to claim 18, and further comprising first and second ground planes mounted in spaced relation from each other and operative with respective first and second helical antenna elements.

22. A satellite antenna system according to claim 18, wherein said ground planes are formed as circular plates.

23. A satellite antenna system according to claim 18, wherein said first and second helical antenna elements comprises monofilar wound wire.

24. A satellite antenna system according to claim 18, wherein said central support shaft comprises a material formed as a dielectric.

25. A satellite antenna system according to claim 18, wherein said helical antenna elements are wound to have one of either right-hand or left-hand polarization.

26. A satellite antenna system comprising:

a satellite body having a transmitter for generating ground-to-earth signals, an earth deck panel, and phase array antenna elements supported by said earth deck panel for emitting the signals;

a reflector boom extending from said satellite body;

an antenna supported by said reflector boom for use in emitting the signals, said antenna comprising:

a reflector having a focal point;

a central support shaft extending axially from the reflector through the focal point;

first and second multi-turn axial mode helical antenna elements disposed on the central support shaft, spaced linear from each other, and wound to have the same polarity, wherein one of said helical antenna elements is disposed on-bore at the focal point and the other helical antenna element is disposed at a defocused position to broaden a transmitted energy beam and area of regard;

first and second independent feed lines extending to respective first and second helical antenna elements; and an antenna feed line switch operatively connected to said feed lines for switching from one feed into the other feed to switch between a narrow beam and a broadened energy beam and area of regard.

27. A satellite antenna system according to claim 26, and further comprising an antenna transmission line operatively connected to said antenna feed line switch and said trams-mitter.

28. A satellite antenna system according to claim 26, wherein said first helical antenna element is spaced distal from said reflector at the focal point, and said second helical antenna element is spaced proximal to the reflector.

29. A satellite antenna system according to claim 26, and further comprising first and second ground planes mounted on said central support shaft in spaced relation from each other and operative with respective first and second helical antenna elements.

30. A satellite antenna system according to claim 29, wherein said ground planes are formed as circular plates supported on said central support shaft.

31. A satellite antenna system according to claim 26, wherein said first and second helical antenna elements comprises monofilar wire wound around said central support shaft.

32. A satellite antenna system according to claim 26, wherein said central support shaft comprises a material formed as a dielectric.

33. A satellite antenna system according to claim 26, wherein said helical antenna elements are wound to have one of either right-hand or left-hand polarization.

34. A satellite antenna system according to claim 1, wherein said helical antenna elements are selectable, such that first and second helical antenna elements can be excited at the same time to allow a broad beam to acquire a target and a narrow beam for tracking.

35. A satellite antenna system according to claim 9, wherein said helical antenna elements are selectable, such that first and second helical antenna elements can be excited at the same time to allow a broad beam to acquire a target and a narrow beam for tracking.

36. A satellite antenna system according to claim 18, wherein said helical antenna elements are selectable, such that first and second helical antenna elements can be excited at the same time to allow a broad beam to acquire a target and a narrow beam for tracking.

37. A satellite antenna system according to claim 26, wherein said helical antenna elements are selectable, such that first and second helical antenna elements can be excited at the same time to allow a broad beam to acquire a target and a narrow beam for tracking.

38. An antenna comprising:

a reflector having a focal point; and first and second selectable, multi-turn axial mode helical antenna elements disposed on-bore and spaced linear from each other, and wound to have the same polarity, wherein one of said helical antenna elements is disposed at the focal point and the other helical antenna element is disposed at a defocused position to broaden a transmitted energy beam and area of regard.

39. An antenna according to claim 38, wherein said first helical antenna element is spaced distal from said reflector at the focal point, and said second helical antenna element is spaced proximal to the reflector.

40. An antenna according to claim 38, and further comprising first and second independent feed lines connecting respective first and second antenna elements.

41. An antenna according to claim 38, wherein said helical antenna elements are wound to have one of either right-hand or left-hand polarization.

42. An antenna according to claim 38, and further comprising a central support shaft that comprises a material formed as a dielectric and extending axially from the reflector through the focal point.

* * * * *